US009016558B2

(12) United States Patent
Alexander

(10) Patent No.: US 9,016,558 B2
(45) Date of Patent: Apr. 28, 2015

(54) ACCESS OPENING CLOSURE DEVICE

(71) Applicant: Thomson Alexander, Dix Hills, NY (US)

(72) Inventor: Thomson Alexander, Dix Hills, NY (US)

( * ) Notice: Subject to any disclaimer, the term of this patent is extended or adjusted under 35 U.S.C. 154(b) by 260 days.

(21) Appl. No.: 13/661,665

(22) Filed: Oct. 26, 2012

(65) Prior Publication Data

US 2013/0104609 A1 May 2, 2013

Related U.S. Application Data

(60) Provisional application No. 61/551,610, filed on Oct. 26, 2011.

(51) Int. Cl.
*A47G 29/12* (2006.01)
*E06B 7/32* (2006.01)

(52) U.S. Cl.
CPC ..... *E06B 7/32* (2013.01)

(58) Field of Classification Search
USPC ..... 232/1 E, 19, 44, 43.1, 43.4, 43.5; 109/19, 67, 68; 49/68; 220/476, 478, 220/479
See application file for complete search history.

(56) References Cited

U.S. PATENT DOCUMENTS

| | | | | |
|---|---|---|---|---|
| 85,647 | A | | 1/1869 | Dolan |
| 618,314 | A | | 1/1899 | Albes |
| 845,964 | A | | 3/1907 | Mittendorf |
| 914,528 | A | | 3/1909 | Thinnes |
| 952,173 | A | | 3/1910 | Zitko |
| 972,948 | A | | 10/1910 | Urban |
| 1,239,307 | A | | 9/1917 | Schmid |
| 1,840,561 | A | | 1/1932 | Bre Miller |
| 2,869,780 | A | | 1/1959 | Jensen |
| 3,110,438 | A | | 11/1963 | Leckner |
| 3,263,854 | A | | 8/1966 | Powers |
| 3,709,539 | A | | 1/1973 | Sodenkamp, Jr. |
| 4,133,996 | A | | 1/1979 | Fread |
| 4,154,103 | A | | 5/1979 | Fling |
| 4,190,004 | A | | 2/1980 | Richardson |
| 4,245,776 | A | | 1/1981 | Miner |
| 4,418,628 | A | | 12/1983 | Cahill |
| 4,517,901 | A | | 5/1985 | Clark |
| 4,571,901 | A | | 2/1986 | Morris et al. |
| 5,205,224 | A | | 4/1993 | Durst |
| 5,615,624 | A | | 4/1997 | Terry et al. |
| 5,799,589 | A | | 9/1998 | Clark |
| 5,802,991 | A | | 9/1998 | Brown et al. |
| 5,897,054 | A | * | 4/1999 | Firth ..... 232/44 |
| 5,921,191 | A | | 7/1999 | Gabel |
| 5,944,205 | A | | 8/1999 | LaJoie et al. |
| 6,082,591 | A | | 7/2000 | Healey |

(Continued)

FOREIGN PATENT DOCUMENTS

| | | |
|---|---|---|
| GB | 2 156 427 | 10/1985 |

*Primary Examiner* — William Miller
(74) *Attorney, Agent, or Firm* — Carter, Deluca, Farrell & Schmidt, LLP

(57) ABSTRACT

An access opening closure device is provided for enabling passage of food or medication into a confined space without providing direct access from within the confined space to outside of the confined space. The device includes a housing assembly including a body and a cover, and a slide assembly including an access door and a frame. The body defines a receptacle and first and second openings. The housing assembly is pivotally coupled to the slide assembly and is movable from an operative position to a stowed, non-operative position.

16 Claims, 12 Drawing Sheets

(56) References Cited

U.S. PATENT DOCUMENTS

| | | | | |
|---|---|---|---|---|
| 6,126,211 | A | 10/2000 | Dominquez | |
| 6,302,325 | B1 * | 10/2001 | Alexander | 232/43.1 |
| 6,378,769 | B1 | 4/2002 | Walgamot | |
| 6,427,879 | B1 | 8/2002 | Caldwell | |
| 6,588,655 | B2 * | 7/2003 | Stapleton, Jr. | 232/44 |
| 6,598,546 | B2 * | 7/2003 | Alexander | 109/67 |
| 6,607,110 | B2 | 8/2003 | Nusbaum | |
| 6,651,876 | B2 * | 11/2003 | Scott | 232/43.1 |
| 6,817,481 | B2 * | 11/2004 | Alexander | 220/476 |
| 7,182,243 | B2 * | 2/2007 | Plappert | 232/19 |
| 7,318,548 | B2 * | 1/2008 | Felice et al. | 232/45 |

* cited by examiner

ACCESS OPENING CLOSURE DEVICE

CROSS-REFERENCE TO RELATED APPLICATION

This application claims priority to, and the benefit of, U.S. Provisional Application Ser. No. 61/551,610, filed on Oct. 26, 2011, the entire contents of which is hereby incorporated herein by reference.

BACKGROUND

1. Technical Field

The present disclosure relates to an access opening closure device for allowing articles to pass through an otherwise impervious wall. More specifically, the present disclosure relates to an access opening closure device for use in prisons and hospital psychiatric wards which allows an article to be passed through a cell or hospital room door without exposing a guard or hospital attendant to possible injury or battery by the prisoner or patient.

2. Background of Related Art

Prison cell and hospital room doors for confining dangerous inmates or patients which are fitted with an access opening to allow passage of food or medication are well known. Such access openings, which may also be used to handcuff an inmate before the hospital or prison cell door is unlocked and opened, is typically covered by a closure device which may be closed to seal the access opening. U.S. Pat. Nos. 6,302,325, 6,598,546 and 6,817,481 disclose known closure devices and are incorporated herein by reference in their entirety.

Known closure devices identified above are supported on respective prison cell or hospital room doors and extend outwardly from the respective doors into an adjacent walkway. It would be desirable to provide an access opening closure device which retains the benefits of prior art closure devices yet is easily movable from an operative position to a stowed, non-operative position.

SUMMARY

An access opening closure device is disclosed which comprises a housing assembly having a body defining a receptacle, a first opening and a second opening. A slide assembly includes a frame member defining a frame opening and an access door movably supported on the frame assembly between a closed position covering the frame opening and an open position uncovering the frame opening. The slide assembly is adapted to be secured to one side of a support structure such that the frame opening is aligned with an opening in the support structure. The frame of the slide assembly includes structure to pivotally secure the frame member of the slide assembly to the housing assembly such that the housing assembly can be selectively pivoted in relation to the slide assembly from an operative position in which the first opening of the body of the housing assembly is aligned with the frame opening to a non-operative position wherein the first opening is pivoted away from the frame opening.

The structure on the frame member of the slide assembly includes at least one hinge member. Each of the at least one hinge members is configured to engage a cylindrical bearing supported on the body of the housing assembly to pivotally secure the housing assembly to the slide assembly. The at least one hinge member can include two hinge members.

In embodiments, the access opening closure device includes a latching device configured to releasably secure the housing assembly in the operative position. The latching device can include a key operated lock. In embodiments, the key operated lock is mounted on the frame and includes a bolt which is configured to be received in a recess formed in the body of the housing assembly to retain the housing assembly in the operative position.

The housing assembly may include a cover supported on the body of the housing assembly which is movable from a first position covering the second opening of the body to a second position uncovering the second opening of the body. The cover can be pivotally secured to the body of the housing assembly. In embodiments, the latching device is supported on the cover for securing the cover in the first position.

The latching device can include a key operated lock which is supported on the cover and includes a bolt. A strike can be supported on the body of the housing assembly and be positioned to be engaged by the bolt.

The access opening closure device can include a key operated lock positioned to secure the access door in the closed position.

The access door can include a strike and the key operated lock can include a bolt which is engageable with the strike to secure the access door in the closed position.

In embodiments, the access door supports a toothed rack and the frame member supports a ratchet member which is supported to engage the toothed rack to prevent movement of the access door towards the open position. The key operated lock may further include a cam member which is positioned to abut the ratchet member when the key operated lock is actuated to disengage the ratchet member from the toothed rack.

In embodiments, the key operated lock is movable between first, second and third positions. In the first position the bolt is engaged with the strike and the ratchet member is engaged with the toothed rack. In the second position, the bolt is disengaged with the strike and the ratchet member is engaged with the toothed rack. In the third position, the bolt is disengaged with the strike and the ratchet member is disengaged from the toothed rack.

BRIEF DESCRIPTION OF THE DRAWINGS

Various embodiments of the presently disclosed access opening closure device are described herein with reference to the drawings, wherein.

DETAILED DESCRIPTION OF EMBODIMENTS

Figure 1:
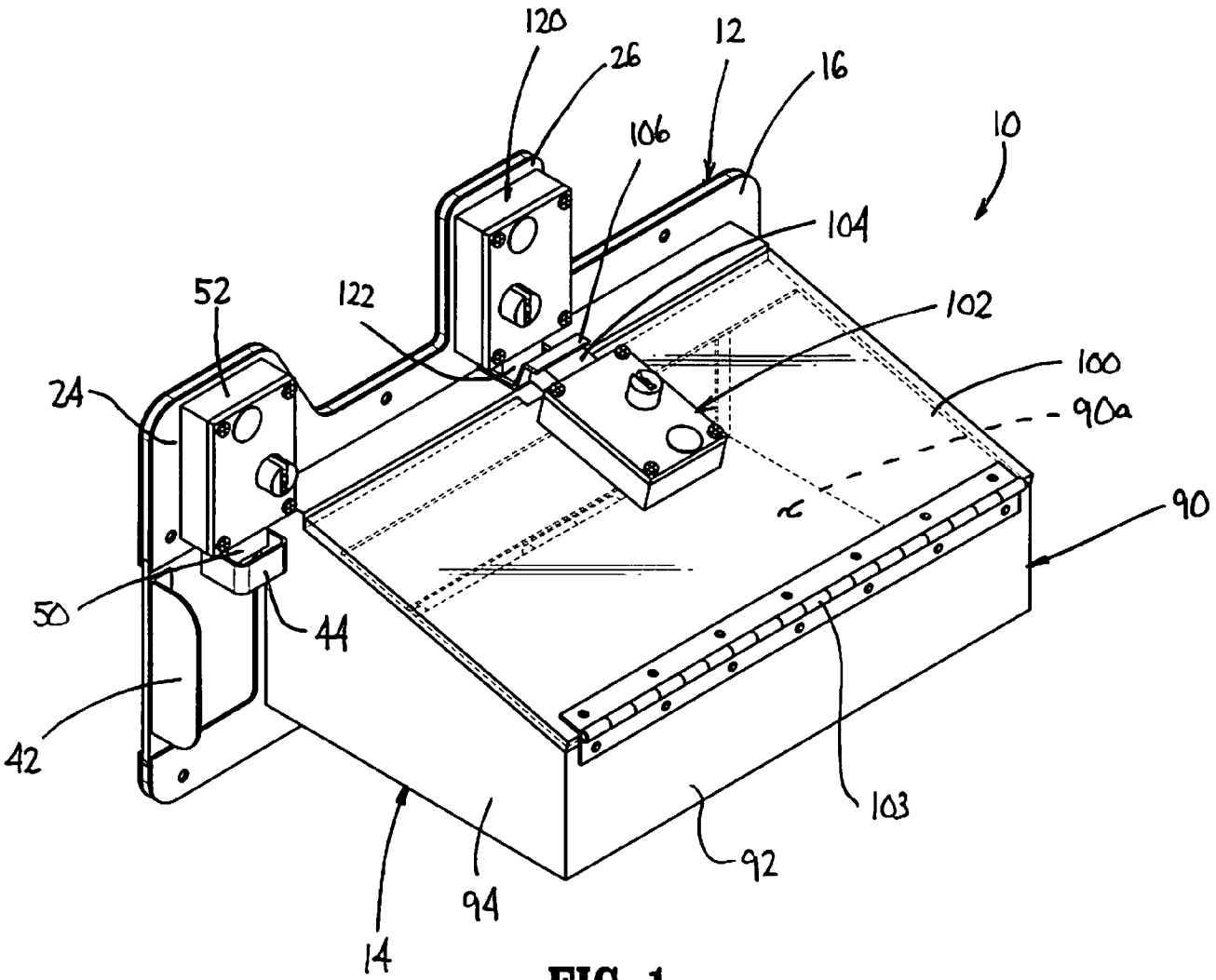
FIG. 1 is a perspective view of one embodiment of the presently disclosed access opening closure device in its operative position with the access door and the cover locked in a closed position.

Embodiments of the presently disclosed access opening closure device will now be described in detail with reference to the drawings, wherein like reference numerals designate identical or corresponding elements in each of the several views.

Figure 8:
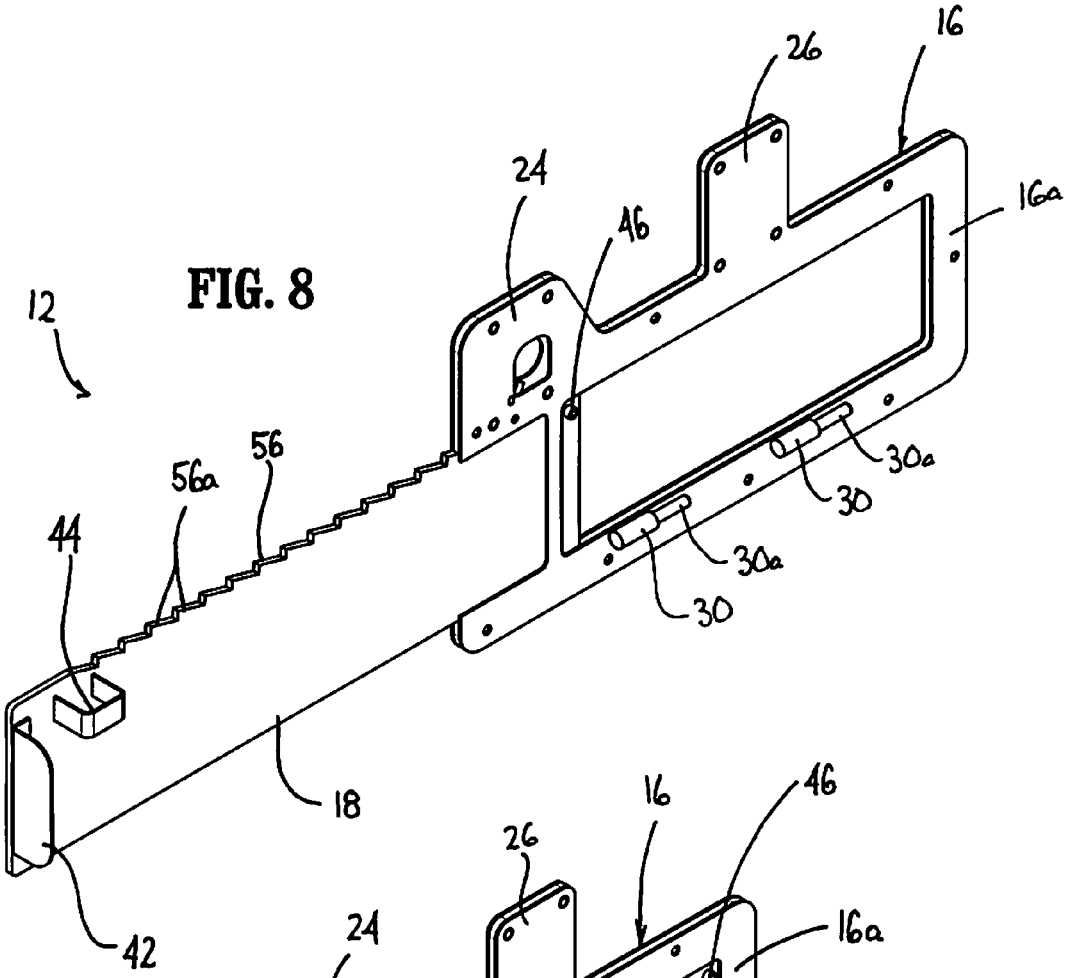
FIG. 8 is a side perspective view of the slide assembly of the access opening closure device shown in FIG. 2 with the access door in the open position.

The presently disclosed access opening closure device, shown in FIGS. 1-9 as 10, includes a slide assembly 12 and a housing assembly 14 which are removably secured together as will be discussed in further detail below. The slide assembly 12 includes a frame 16 and a slidable access door 18. The frame 16 defines a channel 16*a* (FIG. 6) for slidably receiving the access door 18. Frame 16 also defines an opening 20 (FIG. 5) which is covered by the access door 18 when the access door 18 is in a closed position (FIG. 9) and uncovered by the access door 18 when the access door 18 is moved to an open position (FIG. 8). In one embodiment, frame 16 includes a pair of plates 23 which are separated by spacers 23*a* (FIG. 6) to define the channel 16*a* along which the access door 18 is slidable between the open and closed positions. Alternately, other frame constructions are envisioned.

Referring to FIGS. 2, 3 and 5-9, the frame 16 includes a first lock mounting position 24, a second lock mounting portion 26, a vertical strut 28 and a pair of hinge members 30. The frame 16 also defines a plurality of throughbores 34 to facilitate securement of slide assembly 12 about the opening of a support structure such as a prison cell door, hospital door or the like, using bolts (not shown). A plurality of throughbores 32 are also provided on first and second lock mounting portions 24 and 26 to facilitate securement of locks to the frame 16. Throughbores 32 and/or 34 may be threaded or include a threaded insert (not shown) to improve securement of the slide assembly 12 to a support structure or to facilitate securement of a lock to the frame 16.

Figure 9:
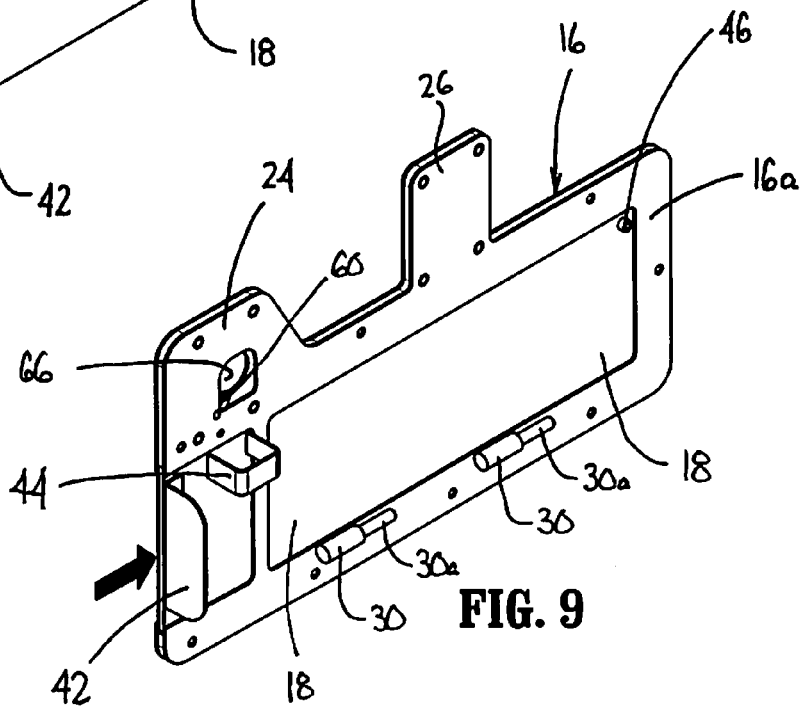
FIG. 9 is a side perspective view of the slide assembly shown in FIG. 8 with the access door in the closed position.

Referring again to FIGS. 1-9, access door 18 includes a handle 42, a catch or strike 44, and stop member 46. Handle 42 is secured to a first end of access door 18 and provides a gripping surface to facilitate movement of the access door 18 between the open and closed positions. Strike 44 is positioned beneath the first lock mounting portion 24 when the access door 18 is in the closed position (FIG. 1) and is positioned to receive the bolt 50 of a lock 52 (FIGS. 10-11) to lock the access door 18 in the closed position. The stop member 46, which may be a screw which is threaded to access door 18, is secured to the access door 18 within the opening 20 and defines a projection which is positioned to engage the vertical strut 28 when the access door 18 is in the open position (FIG. 8) and is positioned to engage the end 16*a* of the frame 16 opposite the vertical strut 28 when the access door 18 is in the closed position (FIG. 9).

Figure 10:
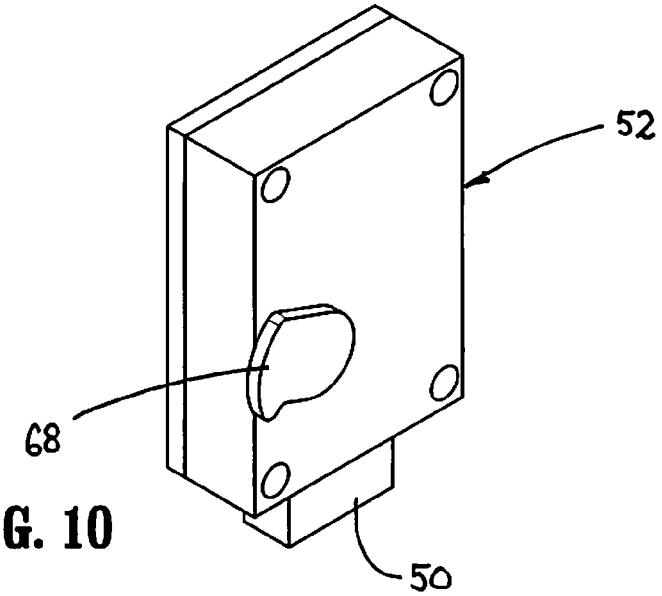
FIG. 10 is a side perspective view of a lock for locking the access door of the access opening closure device shown in FIG. 1.
Figure 11:
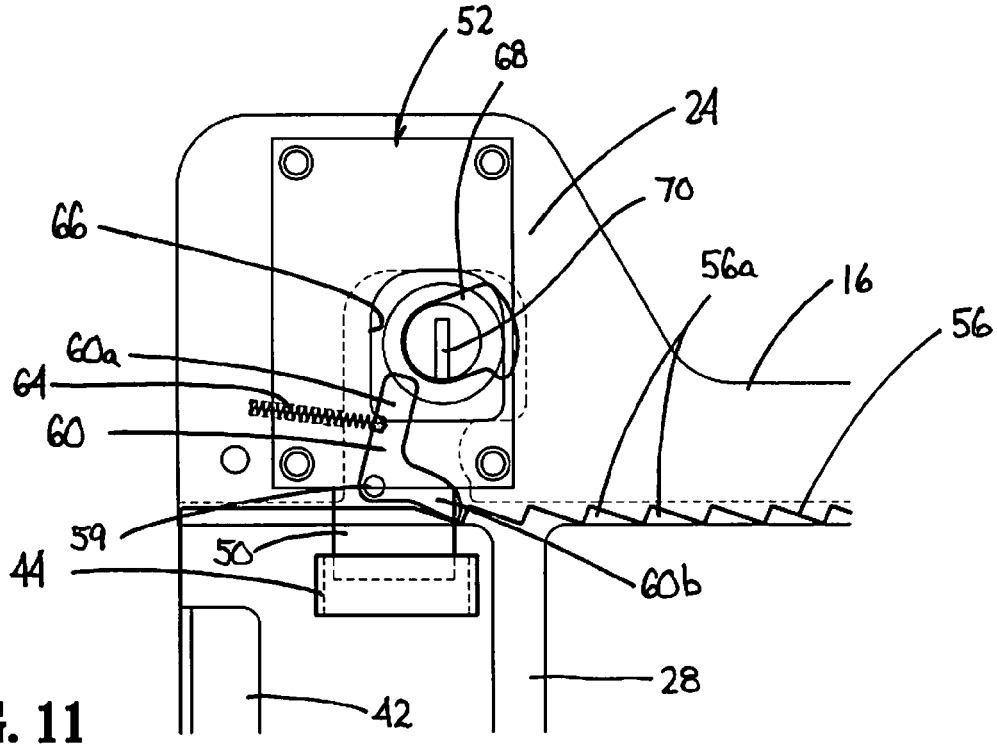
FIG. 11 is a front view, partially in phantom of the lock shown in FIG. 10 mounted to the frame of the slide assembly shown in FIG. 2 in the locked position.
Figure 12:
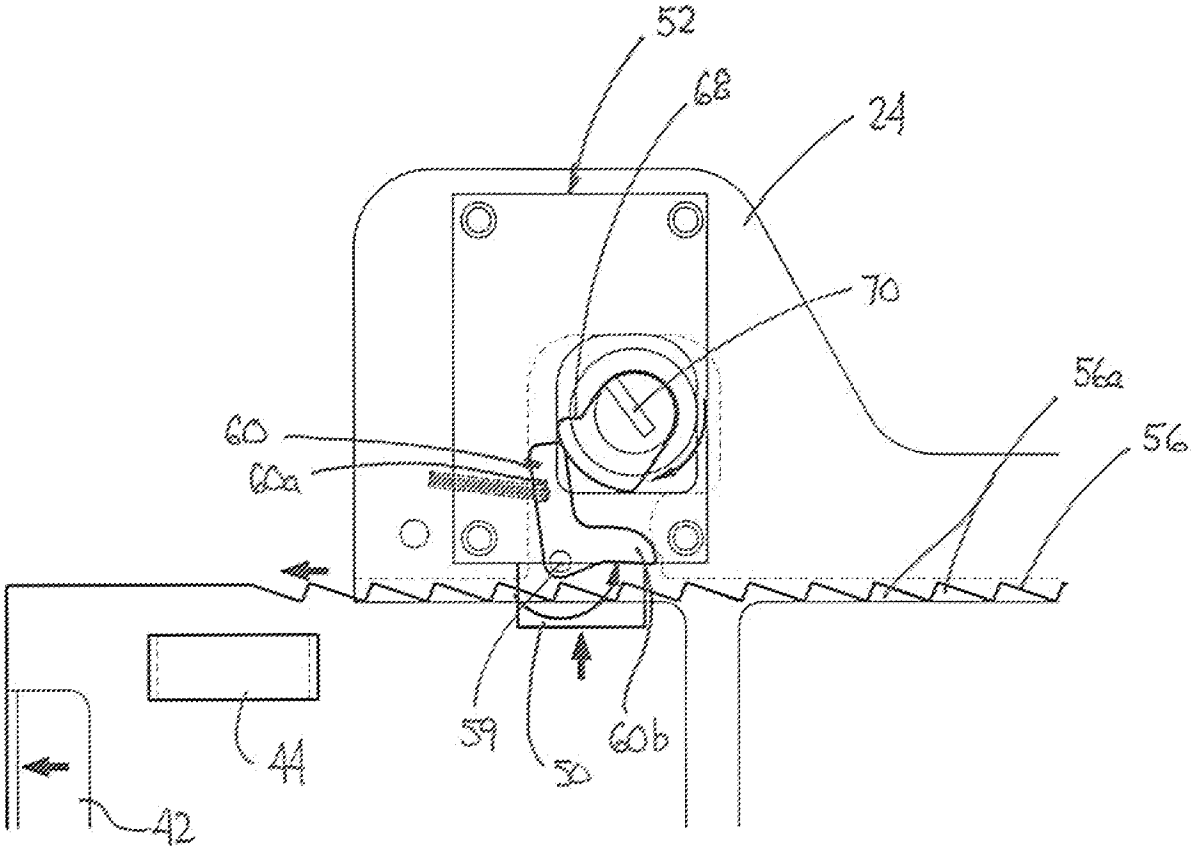
FIG. 12 is a front view shown partially in phantom of the lock shown in FIG. 10 mounted to the frame of the slide assembly in the unlocked position.

Referring to FIGS. 10-12, a top wall of the access door 18 defines a toothed rack 56 having a plurality of teeth 56*a* (FIG. 2B). Each tooth 56*a* has a triangular shape with a substantially vertical wall and a sloped wall. The vertical wall of each tooth prevents movement of access door 18 towards the open position whereas the sloped wall facilitates movement of the access door 18 towards the closed position. A ratchet member 60 is supported adjacent first lock mounting portion 24 on the frame 16 of the slide assembly 12 and is biased into contact with rack teeth 56*a* of rack 56. Ratchet member 60 is pivotally supported within the frame 16 about a pivot member 59 and includes an L-shaped body having a vertical leg 60*a* and a horizontal leg 60*b*. In one embodiment, the ratchet member 60 is biased into contact with rack 56 by a biasing member, e.g., spring 64, which urges a pin or rod (not shown) into contact with vertical leg 60*a* of ratchet member 60. Alternately, the use of other biasing members or assemblies is envisioned.

The vertical leg 60*a* of ratchet member 60 extends into an opening 66 defined in first lock mounting portion 24. When a lock 52 is supported on first lock mounting portion 24, a cam member 68 of lock 52 is positioned within opening 66 such that when a key (not shown) is inserted into a key slot 70 (FIGS. 11-12) of lock 52 and turned to lift bolt 50 from strike 44, cam member 68 is rotated into engagement with vertical leg 60*a* of ratchet member 60 (FIG. 12) to disengage horizontal leg 60*b* of ratchet member 60 from engagement with rack 56. This allows the access door 18 to be freely moved between the opened and closed positions. In one embodiment, the lock 52 is rotatable between three positions. In the first position, the lock bolt 50 is engaged with strike 44 and ratchet member 60 is engaged with rack 56. In the second position, lock bolt 50 is disengaged with strike 44 and ratchet member 60 remains engaged with rack 56. In the third position, lock bolt 50 is disengaged with strike 44 and ratchet member 60 is disengaged from rack 56. In the first position, the access door 18 is locked in the closed position. In the second position, the access door 18, if not already in the closed position, is only movable towards the closed position. Finally, in the third position, the access door 18 may be moved freely between the open and closed positions.

Figure 2:
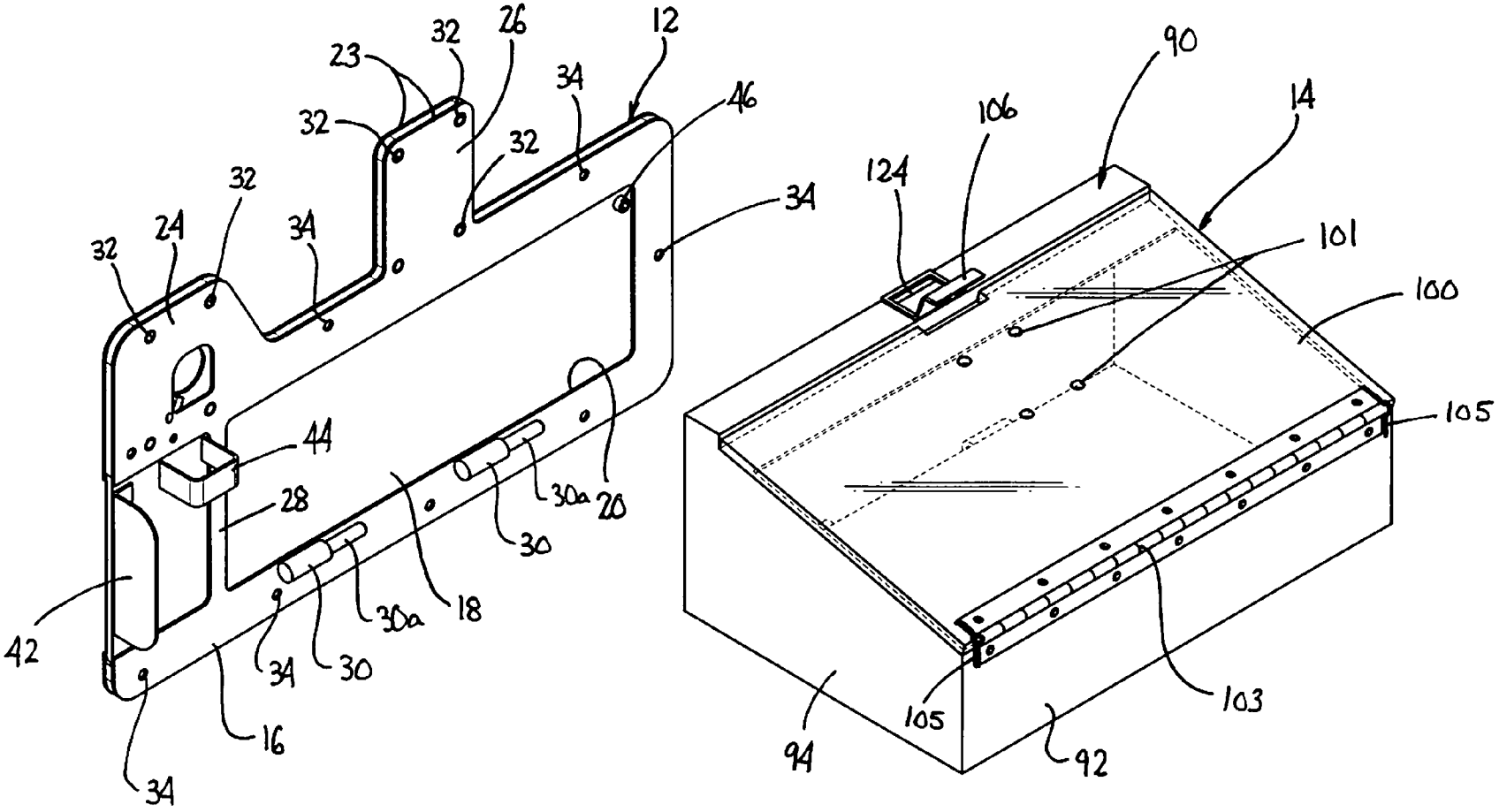
FIG. 2 is a top, perspective view of the access opening closure device with the slide assembly separated from the housing assembly.
Figure 3:
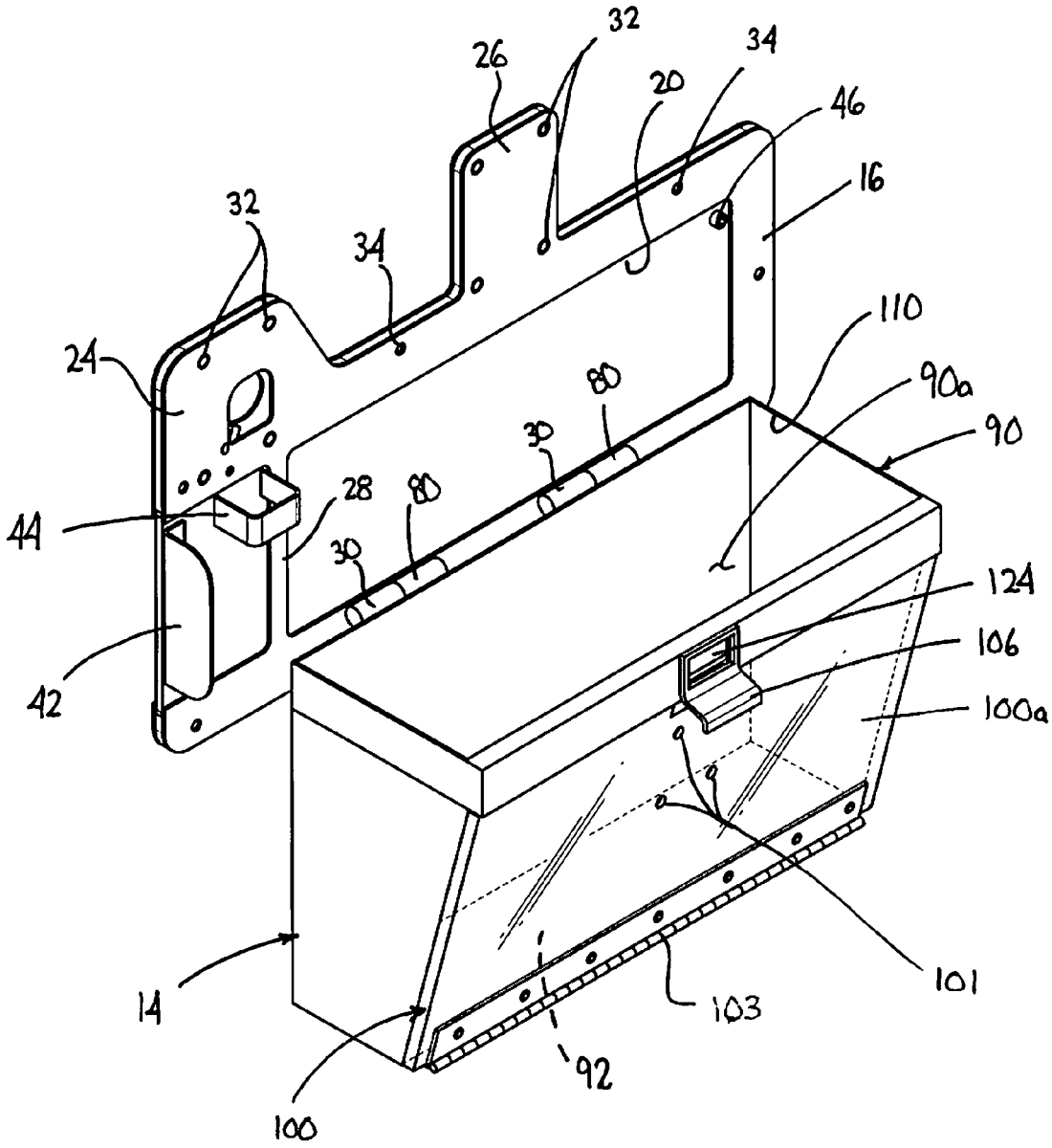
FIG. 3 is a front, perspective view of the access opening closure device in a stowed, non-operative position with the housing assembly pivotally secured to the slide assembly.

As shown in FIGS. 2 and 3, frame 16 of slide assembly 12 includes structure for pivotally attaching the slide assembly 12 to the housing assembly 14. In embodiments, hinge members 30 are supported below opening 20 on frame 16. The hinge members 30 include cylindrical posts 30*a* (FIG. 2) dimensioned to be slidably received in cylindrical bearings 80 (FIG. 4) supported on a bottom surface of housing assembly 14 to pivotally secure housing assembly 14 to frame 16 of slide assembly 12. Although not shown, cylindrical posts 30*a* may define threaded bores which receive bolts to prevent removal of bearings 80 from hinge members 30 and, thus, to prevent removal of housing assembly 14 from slide assembly 12. As shown in FIG. 3, slide assembly 12 is pivotal from an operative position FIG. 1 to a stowed or non-operative position as will be discussed in further detail below.

Figure 4:
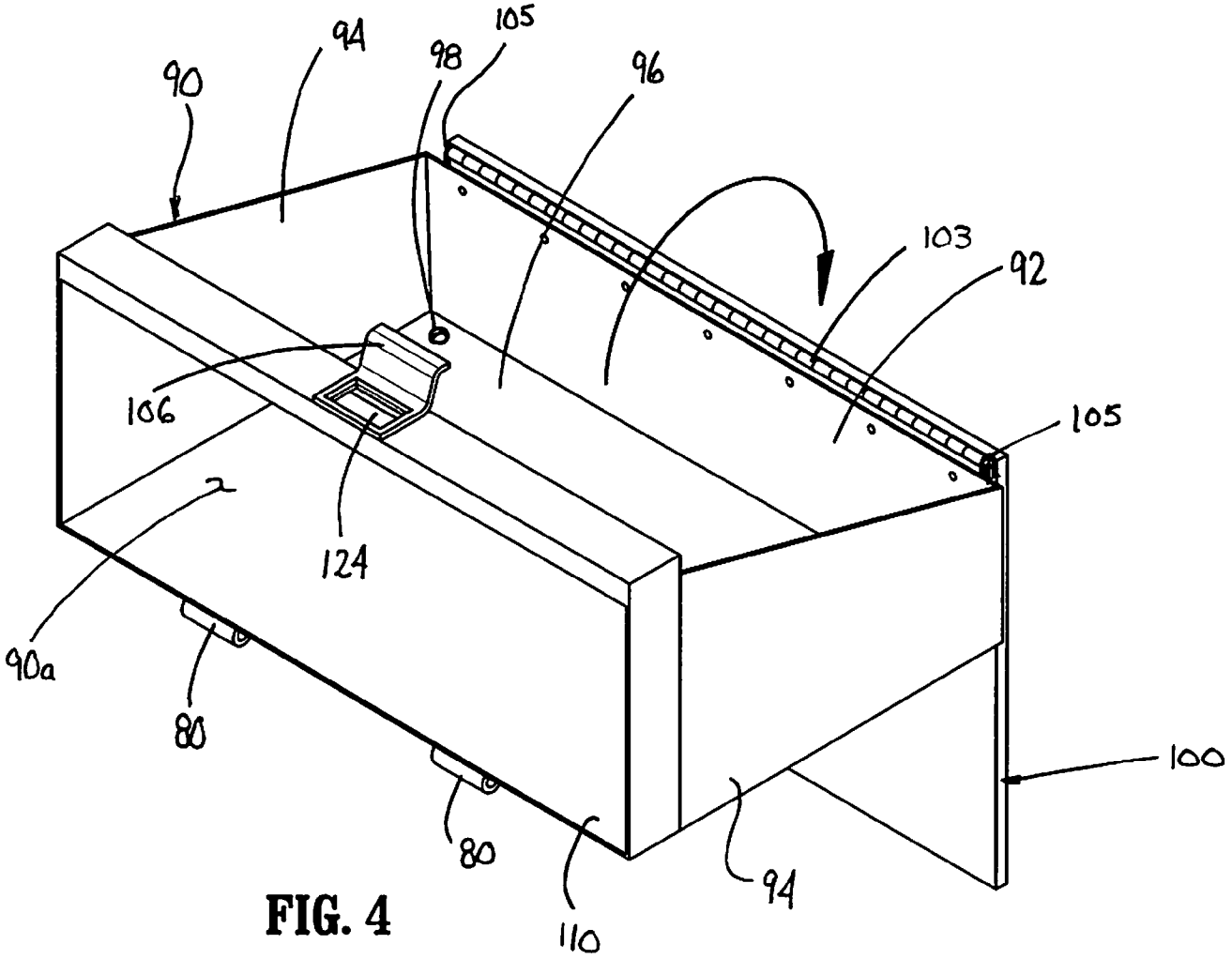
FIG. 4 is a side perspective view from the rear end of the housing assembly of the access opening closure device with the cover in the open position.
Figure 6:
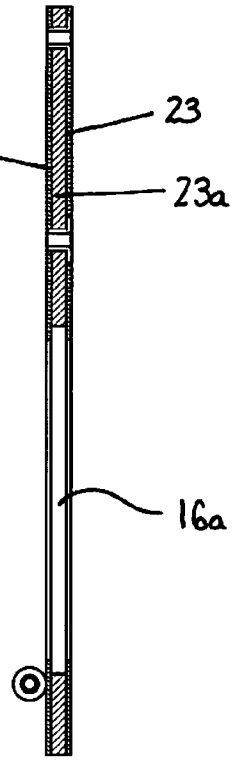
FIG. 6 is a cross-sectional view taken along section lines 6-6 of FIG. 5.
Figure 5:
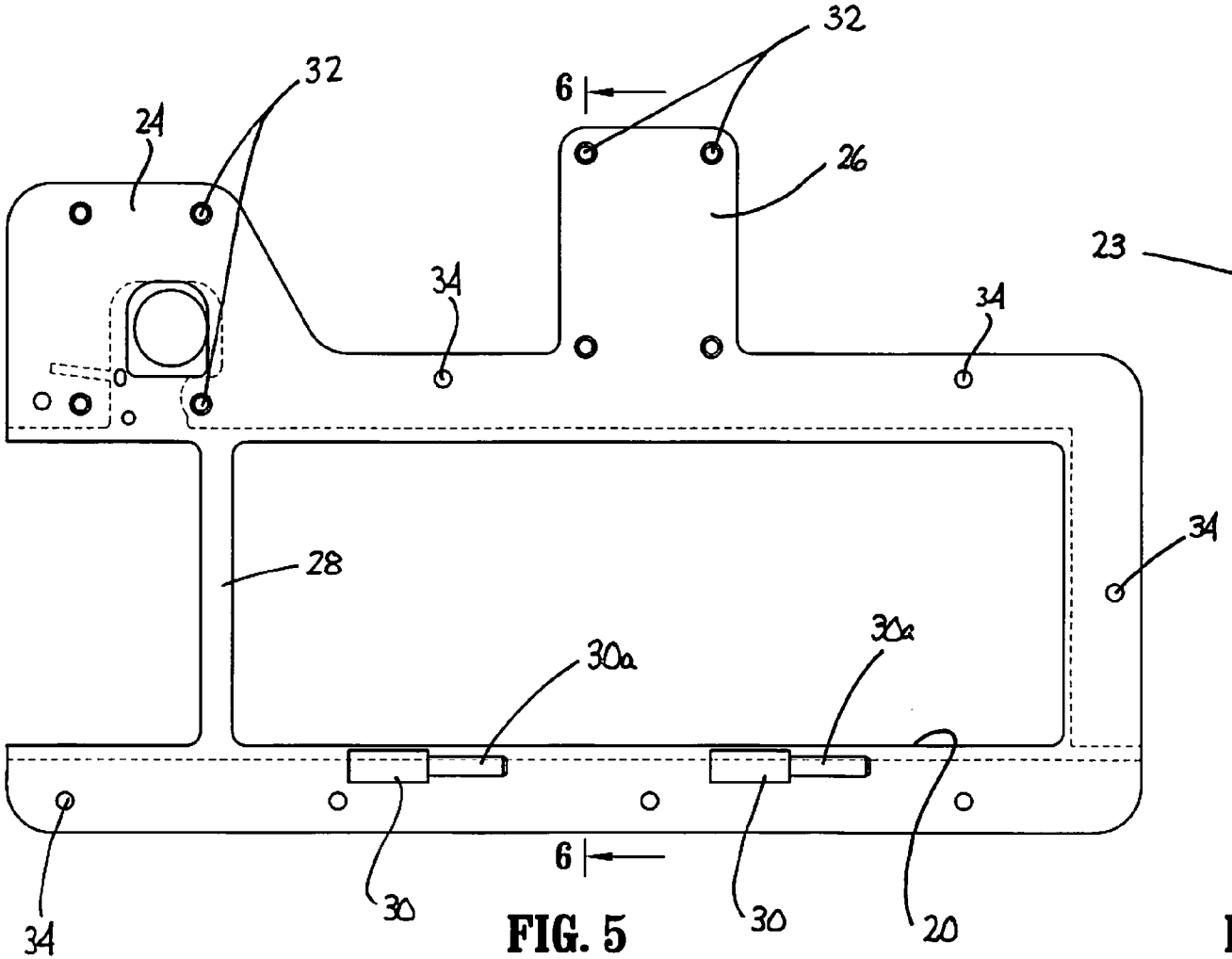
FIG. 5 is a front view of the frame of the slide assembly of the access opening closure device shown in FIG. 1.
Figure 7:
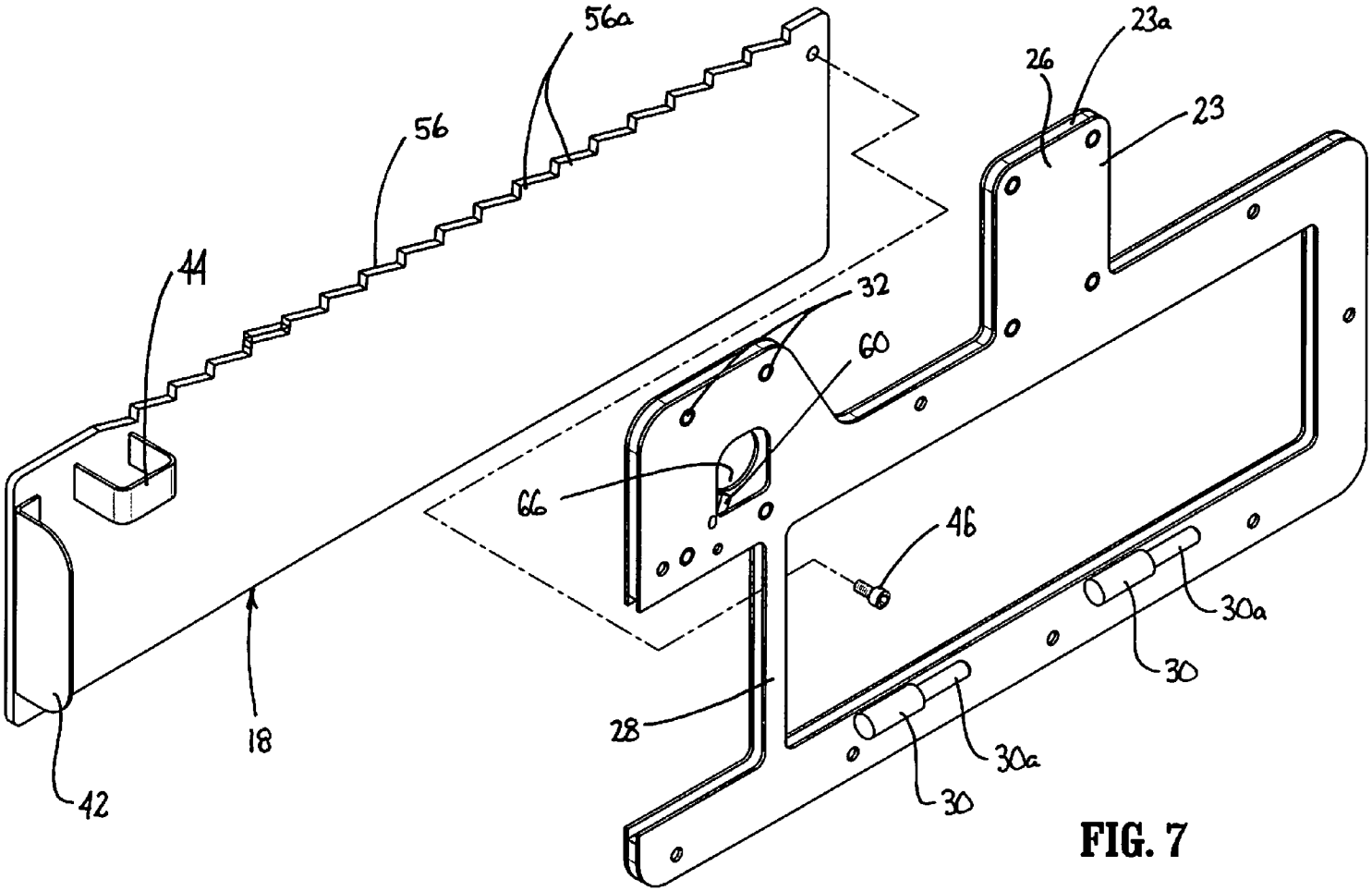
FIG. 7 is a perspective view of the slide assembly of the access opening closure device shown in FIG. 2 with the access door separated from the frame.

Referring to FIGS. 2-4, housing assembly 14 includes a body 90 defining a receptacle 90*a*. Although the body 90 is illustrated as being substantially rectangular, other body configurations are envisioned. In the illustrated embodiment, the body 90 includes a front wall 92, a pair of side walls 94 and a bottom wall 96. Bottom wall 96 may include one or more drain openings 98 (FIG. 4) to facilitate drainage of fluid which may spill into receptacle 90*a*. A cover 100 is movably secured to body 90 to enclose receptacle 90 in a closed position (FIG. 1) and provide access to receptacle 90*a* in an open position (FIG. 4). Although body 90 of housing assembly 14 is illustrated as having an open top which is enclosed by a movable cover 100, it is envisioned that the top surface of body 90 may be enclosed by a fixed wall and that one of the side walls 94 or front wall 92 may be replaced with a removable cover. In one embodiment, cover 100 is formed from a substantially transparent material such as Lexan®. Alternately, other materials of construction are envisioned.

In the illustrated embodiment, cover 100 is hingedly connected by a hinge 103 (FIG. 4) to a top edge of front wall 92 of body 90. Alternatively, cover 100 can be movably mounted to body 90 in a variety of different ways including by slidably mounting cover 100 to body 90. In embodiments, the cover 100 may be urged by a spring member 105 to an open position. The spring member 105 may be incorporated into the hinge 103. Although hinge 103 is shown to be positioned on the top edge of front wall 92, cover 100 may be hinged to the top edge 107 on a rear end of body 18 or to a top edge of either of sidewalls 94.

Referring to FIGS. 1 and 3, a top surface 100*a* of cover 100 defines a series of openings 101 (FIG. 3), which may be threaded, to facilitate securement of a lock 102 (FIG. 1) to cover 100 (FIG. 8). Lock 102 is similar to lock 52 and includes a bolt 104 which is movable to engage a strike 106 supported on body 90 to lock the cover 100 in the closed position.

Referring to FIGS. 3 and 4, body 90 of housing assembly 14 defines a rear opening 110 which is positioned opposite to front wall 92 above cylindrical bearings 80. The housing assembly 14 is mountable to slide assembly 12 by slidably positioning cylindrical bearings 80 on cylindrical posts 30*a* of hinge members 30 (FIG. 3). The housing assembly 14 is pivotable from a first stowed, non-operative position shown in FIG. 3 positioned beneath opening 20 of frame 16 to a second operative position shown in FIG. 1 in which rear opening 110 of housing assembly 14 is positioned in communication with opening 20 of frame 16. In the operative position, access door 18 can be moved from the closed position shown in FIG. 16 to the open position shown in FIG. 14 to provide access to the receptacle 90*a* of housing assembly 14.

Figure 13:
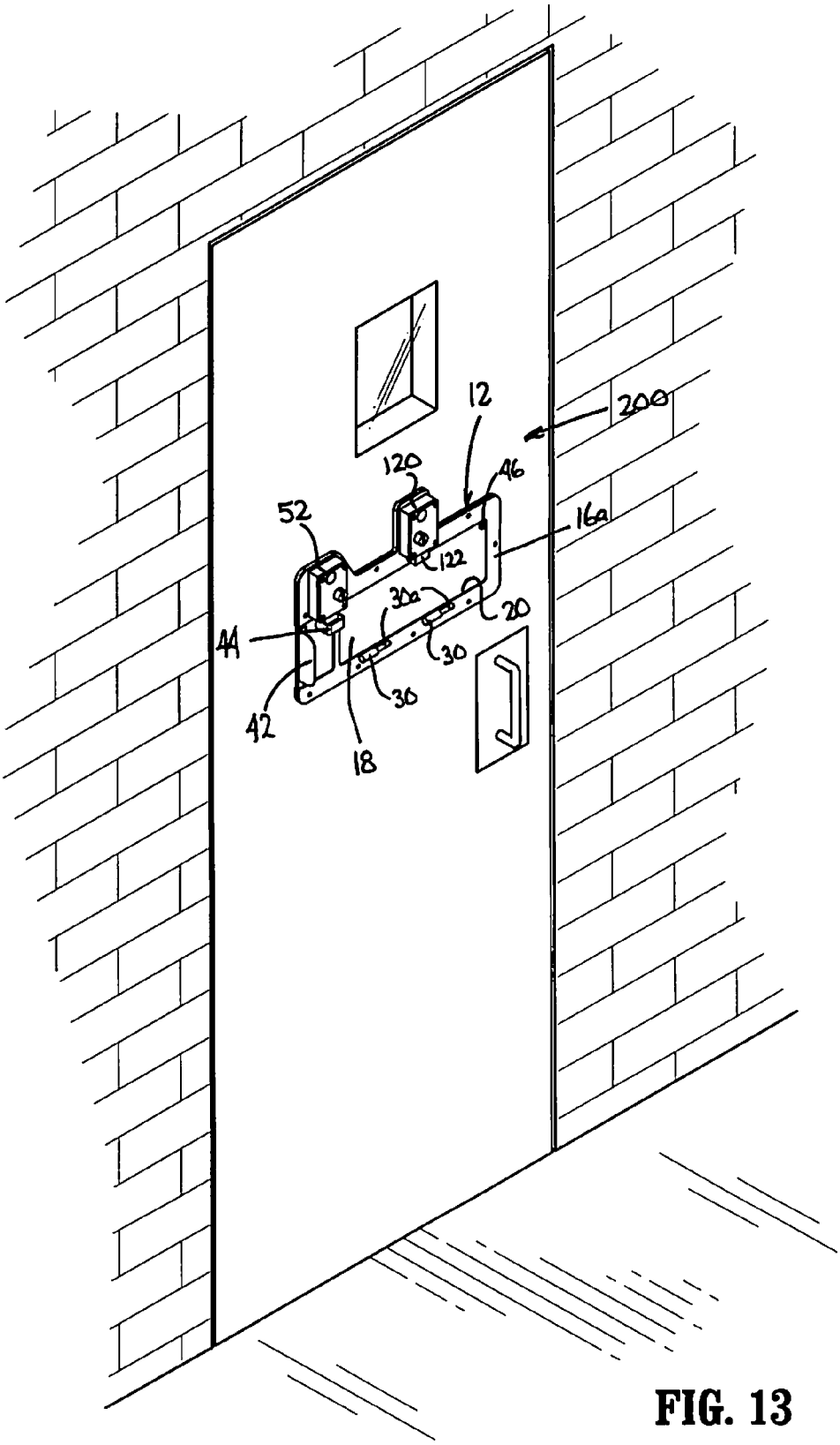
FIG. 13 is a perspective view from the front of the slide assembly secured to a door with the access door in the closed position.
Figure 14:
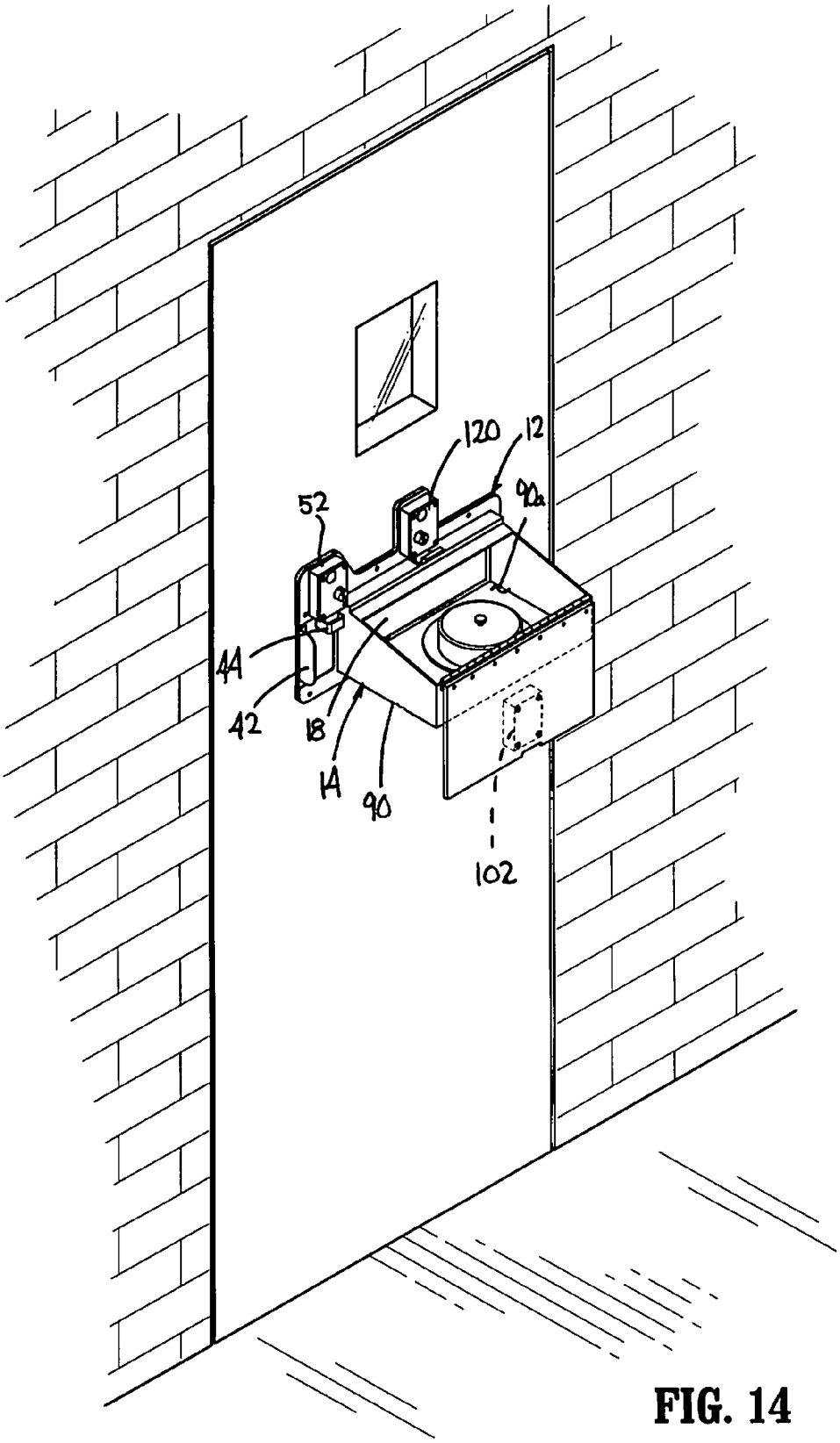
FIG. 14 is a perspective view from the front of the access opening closure device shown in FIG. 1 supported on a door with the cover in an open position and the access door in the closed position.
Figure 15:
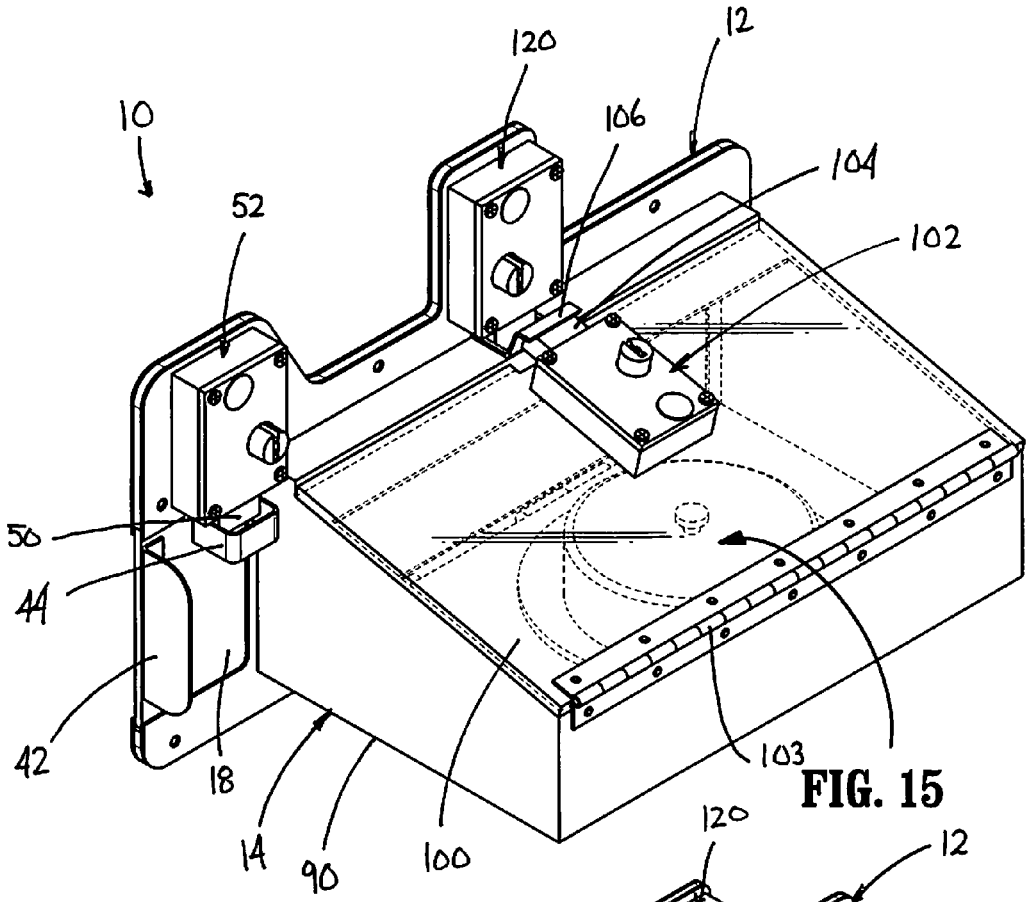
FIG. 15 is a perspective view from the front of the access opening closure device shown in FIG. 1 with the access door and the cover in the closed position.
Figure 16:
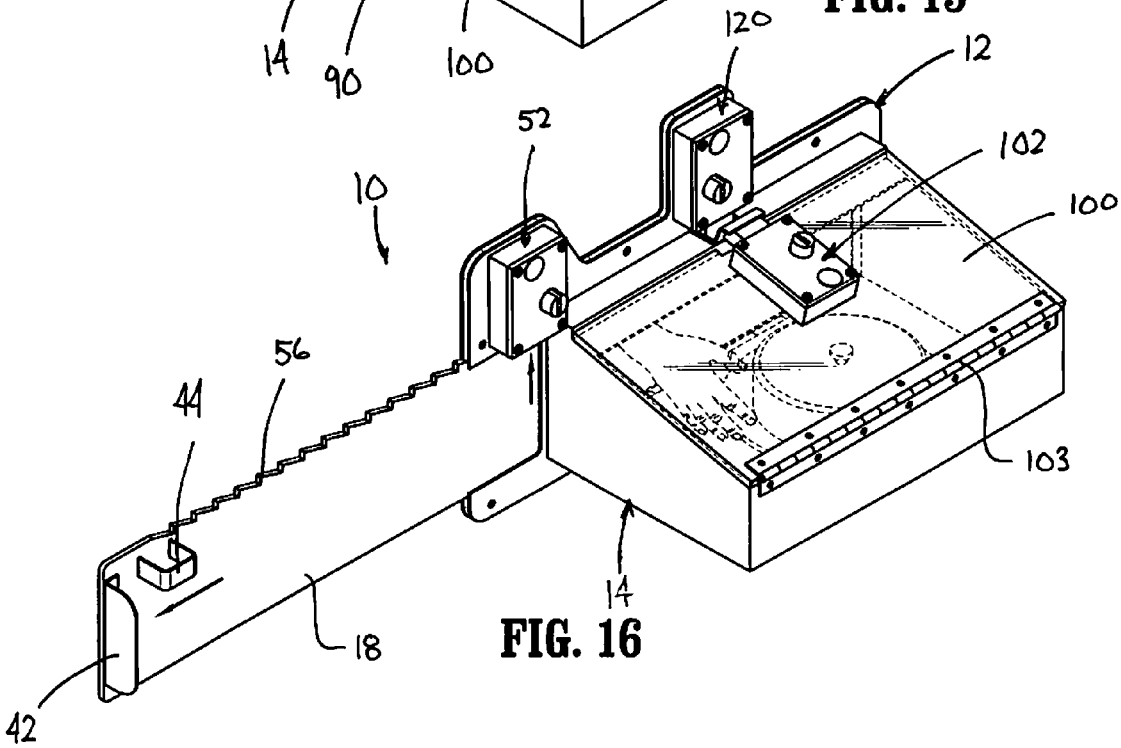
FIG. 16 is a perspective view from the front of the access opening closure device shown in FIG. 1 with the access door of the slide assembly in the open position and the cover in the closed position.

In order to retain the housing assembly 14 in the operative position shown in FIGS. 14-16, a lock 120 is mounted on second lock mounting portion 26 of frame 16. Lock 120 includes a bolt 122 (FIG. 13) which is received in a recess 124 (FIG. 2) formed in an upper side of housing body 90 to prevent housing assembly 14 from pivoting about hinge members 30 from the operative position to the non-operative or stowed position. To position the housing assembly 14 in the non-operative position, lock 120 can be operated with a key (not shown) to lift bolt 122 from recess 124 of housing body 90. When this occurs, gravity will cause the housing assembly 14 to pivot about hinge members 30 to the lowered position. To prevent slamming, the pivoting movement of housing assembly 14 can be controlled by grasping the housing body 90.

Referring to FIGS. 13-16, in use, the slide assembly 12 is secured to a support structure 200 such as a hospital or prison door using bolts or the like such that opening 20 is aligned with an opening (not shown) formed in the support structure 200. Thereafter, the lock 52 can be operated with a key to allow access door 18 to be selectively moved between the open and closed positions to allow selective access to the opening in the support structure 200. The slide assembly 12 is usable independently of the housing assembly 14. If it is desired to limit direct access through the opening in the support structure 200 to the outside world, the housing assembly 14 can be pivotably secured to the slide assembly 12 by positioning cylindrical bearings 80 of body 90 of housing assembly 14 about hinge members 30. Thereafter, the housing assembly 14 can be pivoted to the operative raised position. Lock 120 can be operated with a key (not shown) to retain the housing assembly 14 in the operative position. In the operative position, lock 120 can be operated with a key (not shown) to open cover 102 (FIG. 14) and provide access to receptacle 90*a* of housing 90 while the access door 18 of slide assembly 12 is closed. Thereafter, cover 102 can be closed to cover receptacle 90*a* and access door 18 can be opened to provide access to the receptacle 90*a* through the opening in the support structure and the opening 110 in body 90. See FIG. 16. At any time, if housing assembly 14 is not required, lock 120 can be actuated with a key to allow housing assembly 14 to be pivoted to a stowed or non-operative position (FIG. 3).

Although not shown, the key operated locks 52, 102 and 120 may have spring-loaded bolts such that the bolts may be key operated to open the locks but will automatically return to their locked positions engaged with their respective strikes. In addition, it is noted that only key operated locks are specifically disclosed in this application to control operation of the access door 18, the cover 102 and the pivotally mounted housing assembly 14. However, in embodiments, it is envisioned that one or more of door 18, cover 102 and housing 14 can be retained in the locked position by other non-key operated locking or latching devices. It is also envisioned that the cover 102 can be formed as a single member or a plurality of members.

Persons skilled in the art will understand that the devices and methods specifically described herein and illustrated in the accompanying drawings are non-limiting exemplary embodiments. It is envisioned that the elements and features illustrated or described in connection with one exemplarly embodiment may be combined with the elements and features of another without departing from the scope of the present disclosure. As well, one skilled in the art will appreciate further features and advantages of the system based on the above-described embodiments. Accordingly, the present disclosure is not to be limited by what has been particularly shown and described, except as indicated by the appended claims.

What is claimed is:

1. An access opening closure device comprising:

a housing assembly having a body defining a receptacle, a first opening and a second opening;

a slide assembly including a frame member defining a frame opening and an access door movably supported on the frame member between a closed position covering the frame opening and an open position uncovering the frame opening, wherein the slide assembly is adapted to be secured to one side of a support structure such that the frame opening is aligned with an opening in the support structure;

wherein the frame member of the slide assembly includes structure to pivotally secure the frame member of the slide assembly to the housing assembly such that the housing assembly is selectively pivotal in relation to the slide assembly while secured thereto from an operative position in which the first opening of the body of the housing assembly is aligned and in communication with the frame opening to a non-operative position wherein the first opening is pivoted away from and not in communication with the frame opening.

2. The access opening closure device according to claim 1, wherein the structure on the frame member of the slide assembly includes at least one hinge member, each of the at least one hinge members being configured to engage a cylindrical bearing supported on the body of the housing assembly to pivotally secure the housing assembly to the slide assembly.

3. The access opening closure device according to claim 2, wherein the at least one hinge member includes two hinge members.

4. The access opening closure device according to claim 1, further including a latching device configured to releasably secure the housing assembly in the operative position.

5. The access opening closure device according to claim 4, wherein the latching device includes a key operated lock.

6. The access opening closure device according to claim 5, wherein the key operated lock is mounted on the frame member and includes a bolt which is configured to be received in a recess formed in the body of the housing assembly to retain the housing assembly in the operative position.

7. The access opening closure device according to claim 1, further including a cover supported on the body of the housing assembly, the cover being movable from a first position covering the second opening of the body to a second position uncovering the second opening of the body.

8. The access opening closure device according to claim 7, wherein the cover is pivotally secured to the body of the housing assembly.

9. The access opening closure device according to claim 8, wherein a latching device is supported on the cover for securing the cover in the first position.

10. The access opening closure device according to claim 9, wherein the latching device includes a key operated lock which is supported on the cover and includes a bolt.

11. The access opening closure device according to claim 10, wherein a strike is supported on the body of the housing assembly and is positioned to be engaged by the bolt.

12. The access opening closure device according to claim 1, further including a key operated lock positioned to secure the access door in the closed position.

13. The access opening closure device according to claim 12, wherein the access door includes a strike and the key operated lock includes a bolt which is engageable with the strike to secure the access door in the closed position.

14. The access opening closure device according to claim 13, wherein the access door supports a toothed rack and the frame member supports a ratchet member which is supported to engage the toothed rack to prevent movement of the access door towards the open position.

15. The access opening closure device according to claim 14, wherein the key operated lock further includes a cam member which is positioned to abut the ratchet member when the key operated lock is actuated to disengage the ratchet member from the toothed rack.

16. The access opening closure device according to claim 15, wherein the key operated lock is movable between first, second and third positions, wherein in the first position the bolt is engaged with the strike and the ratchet member is engaged with the toothed rack, in the second position, the bolt is disengaged with the strike and the ratchet member is engaged with the toothed rack, and in the third position, the bolt is disengaged with the strike and the ratchet member is disengaged from the toothed rack.

* * * * *